US007841927B2

(12) United States Patent
Krause et al.

(10) Patent No.: US 7,841,927 B2
(45) Date of Patent: Nov. 30, 2010

(54) HYBRID FIBER-FOAM BUFFING PAD

(75) Inventors: Aaron C. Krause, Cherry Hill, NJ (US); Saul D. Denenberg, Blue Bell, PA (US)

(73) Assignee: 3M Innovative Properties Company, St. Paul, MN (US)

( * ) Notice: Subject to any disclaimer, the term of this patent is extended or adjusted under 35 U.S.C. 154(b) by 863 days.

(21) Appl. No.: 11/329,618

(22) Filed: Jan. 11, 2006

(65) Prior Publication Data

US 2006/0107482 A1 May 25, 2006

Related U.S. Application Data

(63) Continuation of application No. 10/641,899, filed on Aug. 15, 2003, now abandoned.

(51) Int. Cl.
*B24D 11/00* (2006.01)
*B24B 1/00* (2006.01)
*B08B 1/04* (2006.01)

(52) U.S. Cl. ..... 451/526; 51/295; 15/320

(58) Field of Classification Search ..... 451/526, 451/527, 532–534, 539; 51/294, 295, 297, 51/298; 15/98, 230, 230.12
See application file for complete search history.

(56) References Cited

U.S. PATENT DOCUMENTS 1,816,108 A 7/1931 Blumenfeld
2,131,309 A * 9/1938 Bowen ..... 15/230.12
2,332,936 A * 10/1943 Schlegel ..... 15/230.12
2,690,661 A 10/1954 Briggs
3,288,579 A * 11/1966 Coates et al. ..... 51/295
3,392,421 A 7/1968 Mathison
3,418,675 A 12/1968 Meguiar et al.
3,532,588 A 10/1970 Newman
3,862,522 A * 1/1975 Mednick ..... 451/532
4,104,435 A 8/1978 Ballesteros
4,477,938 A 10/1984 Rogut
4,841,684 A * 6/1989 Hall, Jr. ..... 451/532
4,945,687 A * 8/1990 Scheider et al. ..... 451/532
4,962,562 A 10/1990 Englund et al.
5,094,670 A * 3/1992 Imada ..... 51/293
5,185,964 A 2/1993 Englund et al.
5,369,916 A 12/1994 Jefferies et al.
5,482,756 A * 1/1996 Berger et al. ..... 15/230
D367,743 S 3/1996 Krause et al.
5,525,100 A 6/1996 Kelly et al.
5,846,123 A 12/1998 Brown et al.
5,858,140 A 1/1999 Berger et al.
5,947,807 A 9/1999 Overseth
6,024,634 A 2/2000 Hoglund et al.
6,312,485 B1 11/2001 Kaiser et al.
6,349,446 B1 2/2002 Krause et al.
6,589,106 B1 7/2003 Balmelle

* cited by examiner

*Primary Examiner*—Hadi Shakeri

(57) ABSTRACT

A buffing pad primarily for automobiles includes a foam layer and filaments of textile material interspersed throughout the foam layer and extending passed or exposed at the working surface of the pad. The filaments are needle punched through the foam layer. The filaments may be felt fiber such as wool fiber, cotton fiber, or the like.

15 Claims, 2 Drawing Sheets

HYBRID FIBER-FOAM BUFFING PAD

CROSS-REFERENCE TO RELATED APPLICATIONS

This application is a Continuation of U.S. patent application Ser. No. 10/641,899 filed Aug. 15, 2003 now abandoned which is hereby incorporated by reference.

BACKGROUND OF THE INVENTION

The present invention is directed toward a foam hybrid buffing pad for use with a rotary buffing machine for high speed polishing of automobiles, boats, planes, furniture, marble and other surfaces and more particularly, toward a foam buffing pad with wool or other natural or synthetic fibers interspersed throughout and extending passed or exposed at the working surface of the pad.

Buffing pads for use in high speed polishing of automobiles and the like may be one-sided or two-sided. A one-sided buffing pad is typically circular and is attached to a rigid circular backing plate which is attached by a central hub to the shaft of a rotary power buffer. The pad may be permanently attached to the backing plate or releasably attached thereto in order to allow for replacement without disposing of the backing plate.

A two-sided pad includes a buffing pad attached to each face of a rigid backing plate. The plate includes a hub for releasably attaching the pad to the drive shaft or spindle of a high speed buffing motor. The pad may be attached to the motor from either side of the pad, thereby allowing the pad to be reversed after one side has been used.

Typically, such buffing pads are made from tufted wool or from other natural or synthetic fibers. It is also well known to make such pads from a foam material, for example, open cell polyurethane foam. There are, however, certain disadvantages to using either the foam pads or the tufted wool pads.

For example, wool pads frequently lint. That is, during buffing and/or cleaning with a spur the twisted yarns become untwisted and break free from the pad. In body shops this presents a real problem with possible paint contamination, and in a detail shop it is a nuisance and a health hazard as the airborne fibers can be inhaled. Wool is also very aggressive. Wool pads have become notorious with swirl marks and an inexperienced operator can easily burn paint with a wool pad. During buffing the wool pad also can become saturated with compounds and polish becoming a flat hard surface which becomes very aggressive and can also burn the paint off the surface.

Foam was created to solve the major shortcomings of wool. Foam pads do not lint at all and are as easy to clean as a sponge. In addition, an open cell foam material reduces swirl marks and its flexible sponge structure absorbs the compound and polish without becoming a hard aggressive surface prone to burning. One drawback, however, is that foam pads cannot remove deep scratches, wet sand marks, and heavy oxidation as well as wool and certainly not as quickly.

A need exists for a buffing pad that combines the aggressiveness of a wool pad with the ease of cleaning of a foam pad while decreasing the disadvantages of such pads.

SUMMARY OF THE INVENTION

The present invention is designed to overcome the deficiencies of the prior art discussed above. It is an object of the present invention to provide an improved foam hybrid buffing pad for use with a rotary buffing machine for high speed polishing of automobiles, boats, planes, furniture, marble and other surfaces where the pad is made from a combination of foam and wool or other natural or synthetic fibers.

It is another object of the present invention to provide an improved foam hybrid buffing pad for use with a rotary buffing machine for high speed polishing of automobiles, boats, planes, furniture, marble and other surfaces.

In accordance with the illustrative embodiments demonstrating features and advantages of the present invention, there is provided a buffing pad comprised essentially of foam with filaments of wool or other textile material interspersed throughout the foam and extending passed or exposed at the working surface of the pad. Preferably, the filaments are needle punched through the foam. The filaments may be felt fiber such as wool fiber, cotton fiber, or the like.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
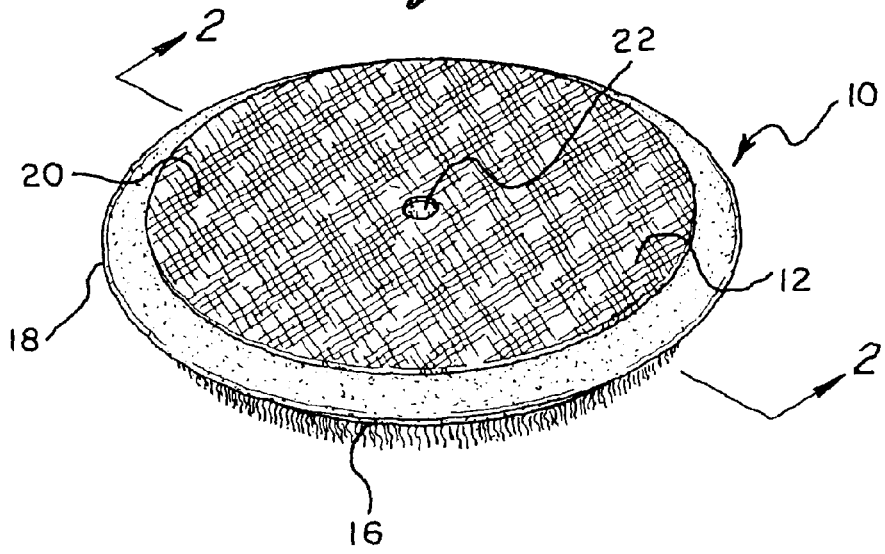
FIG. 1 is a perspective view of one embodiment of a combined foam and wool buffing pad of the invention.

Referring now to the drawings in detail wherein like reference numerals have been used throughout the various figures to designate like elements, there is shown in FIG. 1 a buffing pad constructed in accordance with the principles of the present invention and designated generally as 10. The buffing pad 10 and may be constructed to be a single sided pad such as shown in U.S. Design Pat. No. Des. 367,743 or it may be a double sided pad with or without a quick release mechanism such as shown in U.S. Pat. No. 6,349,446. The disclosures of these two prior patents are hereby incorporated herein by reference.

In either case, the pad 10 includes a main body portion 12 which is comprised essentially of open cell foam such as shown at 14. The body portion has a front working surface 16 with an outer working edge 18 and a back surface 20. As is well known in the art, if the pad 10 is constructed to be double sided, the front and back surfaces will appear to be the same.

It is possible, however, to make the front and back of different materials or different foam densities as desired. In all cases, a hub or similar means 22 is provided at the center of the pad 10 which allows the pad to be connected to a high speed power buffing machine or the like (not shown).

FIGS. 3-7 illustrate the various steps in one embodiment of a process for producing the buffing pad 10 of the invention. Initially, an appropriate block of foam 24 is provided. The block of foam 24 may be square as shown or may be a continuous sheet of foam that may be fed from a roll or the like. Preferably, the foam 24 is comprised of open cell polyurethane but other suitable materials known in the art may also be used. The density of the foam 24 will be selected as desired for the particular purpose for which the pad 10 may be used.

Figure 4:
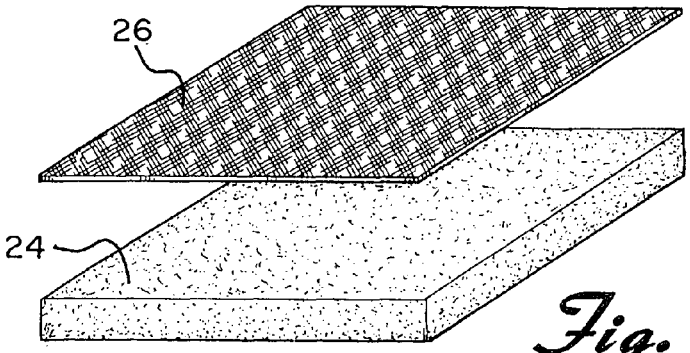
FIG. 4 is a prospective view illustrating the second step in the production of the inventive buffing pad wherein a layer of wool felt is placed over the foam.
Figure 5:
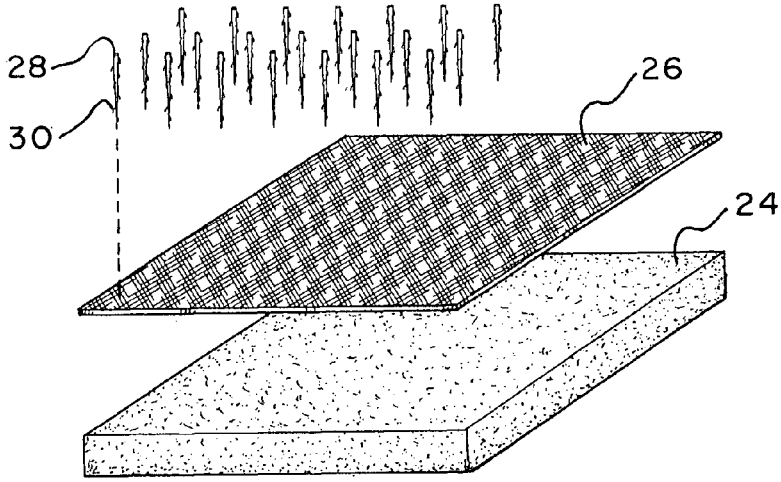
FIG. 5 is a prospective view illustrating a subsequent step in the production of the inventive buffing pad wherein the combined felt and foam are about to be needle punched.

A layer of felt 26 is then placed over the foam 24 as shown in FIG. 4. The felt is preferably made of wool fibers. However, depending on the use for the pad 10, it may be possible to use other natural textile fibers such as cotton or various synthetic fibers. As with the foam 24, the felt 26 may either be cut into a square or other shape as shown or it may be fed from a continuous roll onto the foam 24. The layer of felt 26 is laminated or affixed to the foam 24 through the used of an appropriate adhesive to insure a secure bond therebetween.

With the felt 26 overlying and adhered to the foam 24, the combination is then placed under a plurality of needles 28, each of which carries a plurality of downwardly extending barbs 30. The needles 28 and barbs 30 are, per se, well known and are used to produce what is commonly referred to as needle punched felt and similar materials. Accordingly, a detailed description of the same is not believed to be necessary.

Figure 2:
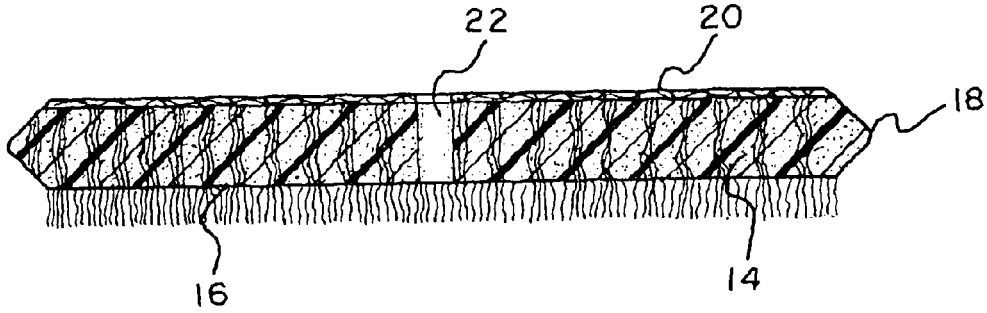
FIG. 2 is a cross-sectional view taken through the line 2-2 of FIG. 1.
Figure 3:
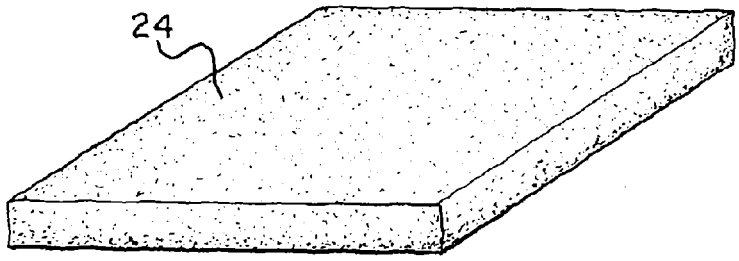
FIG. 3 is a prospective view of a block of foam used in the production of the buffing pad of the invention and illustrating the first step in the production thereof.
Figure 6:
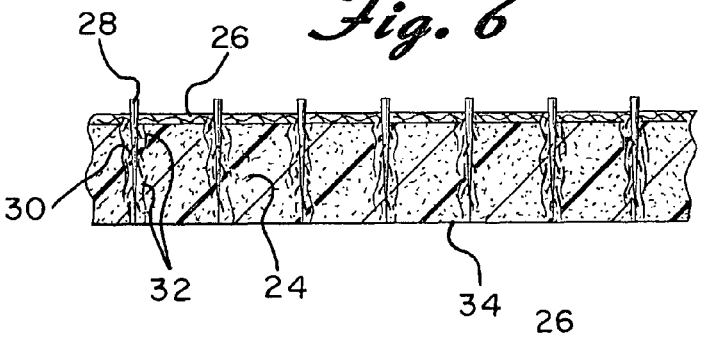
FIG. 6 is a partial cross-sectional view illustrating the needle punching operation used in the production of the inventive buffing pad.

As shown in FIG. 6, as the needles 28 are moved downwardly through the felt 26, the barbs 30 catch a plurality of fibers 32 and draw them downwardly into the foam 24 so that the fibers 32 extend from the back surface 20 and through the foam 24. (See FIG. 2.) Preferably, the ends of the fibers are drawn passed the lowermost surface 34 of the foam 24 so as to be exposed at and to extend beyond the working surface or face. The needles 28 are then raised. However, the elongated filaments of fibers 32 are entangled within and remain in the foam as shown in FIG. 7.

After the needles 28 are raised, the combined felt 26 and foam 24 are shifted and the needles 28 are then again moved downwardly to inject additional wool fibers 32 from the felt 26 into the foam 24. This process can be repeated as many times as desired in order to increase the density of the wool fibers 32 relative to the foam 24. Thus, the density of the fibers 32 relative to the foam 24 is a function of the number of needles 28, the speed of movement of the felt 26 and foam 24 under the needles 28 and the frequency of the up and down strokes of the needles.

Figure 7:
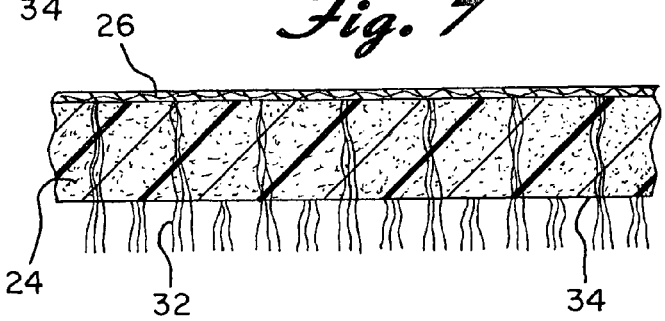
FIG. 7 is a partial cross-sectional view illustrating the needle punched felt and foam combination used to be made into the final buffing pad.

After the wool fibers 32 are needle punched into and through the foam 24 as shown in FIG. 7, the combined block can the be cut to the desired round shape to form a buffing pad. If a single sided pad is being produced, a backing plate will be secured to the felt surface 26 of the combination so that the surface 34 of the foam 24 with the fibers exposed is the working surface and a hub 22 will be provided. If a double sided pad is to be produced, the felt surfaces 26 of two wool injected blocks will be secured together with a mounting plate in between as is well known in the art. As should be apparent, the final buffing pad can be cut into the proper shape before of after the backing or mounting plate and hub etc. are assembled.

Although the preferred process for producing the invention is to needle punch the wool felt into the foam, it may be possible to utilize other methods for accomplishing the same. For example, it may be possible to utilizing a tufting process to secure wool or other textile fiber tufts to the foam. In addition, it may be possible to mix wool or other fibers with the urethane prior to foaming the same so that the fibers will be dispersed throughout the foam pad after it is formed.

The present invention may be embodied in other specific forms without departing from the spirit or essential attributes thereof and accordingly, reference should be made to the appended claims rather than to the foregoing specification as indicating the scope of the invention.

We claim:

1. A buffing pad for polishing surfaces comprising:

a generally circular layer of foam material having a working face;

filaments of textile material extending through said foam material and extending beyond said working face, and means for securing said pad to a rotary power buffer.

2. The buffing pad of claim 1 wherein said filaments are felt fibers.

3. The buffing pad of claim 1 wherein said filaments are wool fibers.

4. The buffing pad of claim 1 wherein said filaments are cotton fibers.

5. The buffing pad of claim 1 wherein said foam material is open cell polyurethane foam.

6. A buffing pad for polishing surfaces comprising:

a generally circular layer of foam material having a working face;

filaments of textile material interspersed throughout said foam material and extending beyond said working face, and means for securing said pad to a rotary power buffer.

7. The buffing pad of claim 6 wherein said filaments are felt fibers.

8. The buffing pad of claim 6 wherein said filaments are wool fibers.

9. The buffing pad of claim 6 wherein said filaments are cotton fibers.

10. The buffing pad of claim 6 wherein said foam material is open cell polyurethane foam.

11. A buffing pad for polishing surfaces comprising:

a combination of a foam material and filaments of textile material, said foam material having a working face and said filaments extending beyond said working face, and means for securing said pad to a rotary power buffer.

12. The buffing pad of claim 11 wherein said filaments are felt fibers.

13. The buffing pad of claim 11 wherein said filaments are wool fibers.

14. The buffing pad of claim 11 wherein said filaments are cotton fibers.

15. The buffing pad of claim 11 wherein said foam material is open cell polyurethane foam.

* * * * *